US010815743B2

(12) United States Patent
Liu et al.

(10) Patent No.: US 10,815,743 B2
(45) Date of Patent: Oct. 27, 2020

(54) DEPRESSURIZ OD FOR DOWNHOLE ANNULUS DRILLING FLUID

(71) Applicant: CHINA UNIVERSITY OF PETROLEUM (EAST CHINA), Qingdao (CN)

(72) Inventors: Yongwang Liu, Qingdao (CN); Zhichuan Guan, Qingdao (CN); Yucai Shi, Qingdao (CN); Hualin Liao, Qingdao (CN); Ben Guan, Qingdao (CN)

(73) Assignee: CHINA UNIVERSITY OF PETROLEUM (EAST CHINA), Qingdao (CN)

( * ) Notice: Subject to any disclaimer, the term of this patent is extended or adjusted under 35 U.S.C. 154(b) by 0 days.

(21) Appl. No.: 16/874,605

(22) Filed: May 14, 2020

(65) Prior Publication Data

US 2020/0270959 A1 Aug. 27, 2020

Related U.S. Application Data

(63) Continuation of application No. PCT/CN2019/094189, filed on Jul. 1, 2019.

(30) Foreign Application Priority Data

Nov. 22, 2018 (CN) ..... 2018 1 1401209

(51) Int. Cl.
*E21B 21/08* (2006.01)
*E21B 21/10* (2006.01)
*E21B 17/07* (2006.01)

(52) U.S. Cl.
CPC ..... *E21B 21/08* (2013.01); *E21B 17/07* (2013.01); *E21B 21/10* (2013.01)

(58) Field of Classification Search
CPC ..... E21B 21/08; E21B 21/103; E21B 17/07; E21B 17/076
See application file for complete search history.

(56) References Cited

U.S. PATENT DOCUMENTS

| | | | |
|---|---|---|---|
| 4,194,582 | A | 3/1980 | Ostertag |
| 8,215,403 | B1 | 7/2012 | Penisson |
| 2017/0107771 | A1 | 4/2017 | Morse |

FOREIGN PATENT DOCUMENTS

| | | | |
|---|---|---|---|
| CM | CN101787858 | B | 8/2013 |
| CN | 201196045 | Y | 2/2009 |

(Continued)

OTHER PUBLICATIONS

International Search Report for PCT/CN2019/094189.
Search Report for CN201811401209.3.

*Primary Examiner* — Giovanna Wright
(74) *Attorney, Agent, or Firm* — J.C. Patents

(57) ABSTRACT

A depressurization device for downhole annulus drilling fluid includes a central shaft and a barrel body sheathed outside the central shaft, the central shaft includes a force transmission shaft and a liquid separation piston; the barrel body includes a spline barrel, an elastic element protection barrel, a connector and a depressurization barrel; the elastic element protection barrel and the connector are sheathed outside the force transmission shaft; an elastic element is arranged between the elastic element protection barrel and the force transmission shaft; the depressurization barrel is sheathed outside the liquid separation piston; a first liquid storage chamber and a second liquid storage chamber are formed; a first inlet passage and a first drain passage are formed on the connector; a second inlet passage and a second drain passage are formed on the depressurization barrel; suction valves are arranged on the first inlet passage and the second inlet passage; and, second drain valves are (Continued)

arranged on the first drain passage and the second drain passage. In the present application, by using the vibration of a drill string as an energy source, the pressure of downhole drilling fluid is reduced.

15 Claims, 8 Drawing Sheets

(56) References Cited

FOREIGN PATENT DOCUMENTS

| | | | |
|---|---|---|---|
| CN | 201218066 | Y | 4/2009 |
| CN | 203175399 | U | 9/2013 |
| CN | 102536114 | B | 6/2014 |
| CN | 102704857 | B | 6/2014 |
| CN | 103899250 | B | 7/2014 |
| CN | 103114809 | B | 3/2015 |
| CN | 104563930 | A | 4/2015 |
| CN | 103899250 | B | 11/2015 |
| CN | 104499941 | B | 10/2016 |
| CN | 109555492 | A | 4/2019 |

DEPRESSURIZ OD FOR DOWNHOLE ANNULUS DRILLING FLUID

CROSS-REFERENCE TO RELATED APPLICATION

This application is a continuation application of international Application No. PCT/CN2019/094189, filed on Jul. 1, 2019, which in turn claims the priority benefits of Chinese Patent Application No. 201811401209.3, filed on Nov. 22, 2018. The contents of the above identified applications are incorporated herein by reference in their entirety.

TECHNICAL FIELD

The present application belongs to the technical field of petroleum and natural gas drilling engineering, and relates to a depressurization device and method for drilling fluid, in particular to a depressurization device and method for downhole annulus drilling fluid which is used for reducing the pressure of downhole annulus drilling fluid.

BACKGROUND OF THE PRESENT INVENTION

The vibration of a drill string brings great danger to the drilling operation. However, it is also indicated that the vibration of the drill string contains huge energy although it can bring great danger. If the vibration of the drill string can be transformed into favorable energy for rational utilization, the energy can be provided for the operation of deep-well downhole tools, and the risk in the drilling process can be reduced. Based on this idea, the China University of Petroleum (East China) has developed a device for transforming the vibration energy of a drill string into the hydraulic energy of drilling fluid, and has also designed a device for transforming the vibration energy of a drill string into the axial impact of a drill bit, a device capable of transforming the vibration energy of a drill string into the torsional impact of a drill bit, or the like.

Chinese Patent No. CN103114809B has disclosed a vibration-absorption downhole hydraulic pulse generation device and a well drilling method thereof, wherein the device includes a drill string linkage body and a drill string separate movement body. All the downhole drilling fluid can be effectively compressed and pressurized effectively, and the transfer of vibration energy of the drill string and the generation of pulsed jet can be realized.

Chinese Patent No. CN103899250B has disclosed a device for improving the oil-gas drilling speed, including: a mandrel body, a spline outer barrel, a spring protection barrel, a spring assembly, a lower spring plugging connector, a piston assembly and a pressurization assembly outer barrel. This device introduces annular drilling fluid into a cavity of a drill string, and achieves the purpose of pressurizing all the drilling fluid in the cavity of the drill string, increasing pulse and increasing discharge capacity and Abrasive Water jet.

Chinese Patent No. CN102704857B has disclosed an underground pressurization and acceleration system. The technical solution is that the underground pressurization and acceleration system mainly includes a drill string stress transmission assembly, a torque transmission and pressure bearing assembly, an elastic reset element assembly, a pressurization cylinder, an ultrahigh pressure drilling fluid transmission assembly and a drill bit. The vibration of the drill string can be reduced, the pressure of part of drilling fluid can be increased, the pressurized drilling fluid is delivered to the downhole for injection to assist rock breakage, and the oil-gas drilling speed is increased.

Chinese Patent No. CN101787858B has disclosed an underground drill string vibration absorption and pressurization device, including an upper adapter, a spring, a central shaft, a piston shaft, a locking nut, a water inlet valve, a sealing assembly, a pressurization cylinder, a pressurization cylinder centralizing barrel, a pressurization cylinder outer barrel, a water outlet valve, a high-pressure flow passage and a lower adaptor. The downhole pressurization of the drilling fluid can be realized, the vibration of the drill string can be reduced to protect the drill string, and the jet pressure of a drill bit nozzle can be increased to improve the rock breaking efficiency.

Chinese Patent No. CN102536114B has disclosed a mechanical underground vibration-absorption impact drilling tool, which combines the vibration absorption of the drill string with the high-frequency and low-impact-energy impact on the drill bit, transforms the longitudinal vibration, which is easy to cause the fatigue damage of the drill string, into the internal energy of the vibration-absorption reset spring, so that it is advantageous to improve the impact energy of the drilling speed, realize rotary percussion drilling and improve the rock breaking efficiency.

Chinese Patent No. CN104499941B has disclosed a device for transforming the longitudinal vibration of a drill string into the torsional impact of a drill bit, including a longitudinal vibration assembly, a reset torsion transmission assembly and a torsion generation and transmission assembly. This device can transform the harmful longitudinal vibration of the drill stem into circumferential high-frequency torsional impact vibration of the drill bit in the drilling process, so that the mechanical drilling speed is increased.

The development and design of these devices provide new ideas for the field of deep well drilling speed improvement. The utilization of the vibration energy of the drill string is not limited to the above methods. The rational utilization of the vibration energy of the drill string will provide more methods and devices beneficial to drilling.

An annular space, also referred to as a downhole annulus, will be formed between the well drilling and the drill bit during the drilling process, and the drilling fluid filled in the downhole annulus is called downhole annulus drilling fluid. The practices at drilling sites have indicated that, by reducing the pressure of the downhole annulus drilling fluid, the rock elimination effect at the drill bit can be improved, the stress state of the rock to be drilled can be changed, and the drilling speed can be increased. Therefore, scholars in China and foreign countries have proposed two methods to reduce the pressure of the downhole annulus drilling fluid. In one method, the pressure of the downhole annulus drilling fluid is reduced by reducing the density of the drilling fluid in the whole wellbore, i.e., underbalanced drilling. This method greatly improves the drilling efficiency, but it has the problem of not being widely applicable. For example, it is difficult to apply this drilling method to complex stratum such as abnormally high pressure stratum. In the other method, the pressure of the downhole annulus drilling fluid is reduced by reversely jetting of a part of the drilling fluid in the well by an underground tool. This method can reduce the pressure of the downhole annulus drilling fluid to a certain extent at the expense of decreasing the injection quantity of the downhole drilling fluid. The practical experience has indicated that the rock elimination effect of the jet flow will be reduced if the discharge capacity of the downhole drilling fluid is reduced. Therefore, the contribution of the above method to the improvement of the drilling efficiency needs to be further studied.

SUMMARY OF THE PRESENT INVENTION

In view of the problems in the prior art, the present application provides a depressurization device and method for downhole annulus drilling fluid based on drill string vibration, which realize the depressurization of the annular drilling fluid by utilizing the vibration of a drill string as an energy source for the device, so as to increase the well drilling speed.

For this purpose, the present application provides a depressurization device for downhole annulus drilling fluid, including a central shaft and a barrel body sheathed outside the central shaft, the central shaft includes a force transmission shaft and a liquid separation piston, which are connected successively; the barrel body includes a spline barrel, an elastic element protection barrel, a connector and a depressurization barrel, which are all connected successively; the elastic element protection barrel and the connector are sheathed outside the force transmission shaft; an elastic element having an end in contact-type connection to the connector is provided between the elastic element protection barrel and the force transmission shaft; the depressurization barrel is sheathed outside the liquid separation piston; a first liquid storage chamber is formed among the depressurization barrel, the connector and the liquid separation piston, and a second liquid storage chamber is formed between the depressurization barrel and the liquid separation piston; a downward first inlet passage and an upward first drain passage which both communicate the outside with the first liquid storage chamber are provided on the connector; an upward second inlet passage and a downward second drain passage which both communicate the outside with the second liquid storage chamber are provided on the depressurization barrel; at an end of the first inlet passage which communicated with the outside, a first suction valve is provided; at an end of the first drain passage which communicated with the outside, a first drain valve is provided; at an end of the second inlet passage which communicated with the outside, a second suction valve is provided; and, at an end of the second drain passage which communicated with the outside, a second drain valve is provided.

Further, a stroke limiter is provided between the force transmission shaft and the elastic element protection barrel; and, an end of the elastic element is in contact-type connection to the stroke limiter, while the other end thereof is in contact-type connection to the connector.

Further, the barrel body further includes a sealing end cover; the sealing end cover is sheathed outside the force transmission shaft.

Preferably, the force transmission shaft is provided with a circular hole along its axis for the drilling fluid flowing, and a drill collar threads for connecting a drill tool assembly is provided at a top end of the force transmission shaft; and, a cylindrical surface for fastening, a first sealing surface in sealed connection to the sealing end cover, a spline in sealed connection to the spline barrel, threads for limit for connecting with the stroke limiter, an inner cylindrical surface of the space where the elastic element is located and piston threads for connecting with the liquid separation piston are successively provided outside the force transmission shaft, the diameter of the first sealing surface is less than that of the cylindrical surface for fastening, the addendum circle diameter of the spline is equal to the diameter of the first sealing surface, the root circle diameter of the spline is greater than the major diameter of the threads for limit, the minor diameter of the threads for limit is greater than the diameter of the elastic element internal support cylindrical surface, and the diameter of the elastic element internal support cylindrical surface is greater than the major diameter of the piston threads.

Preferably, the spline barrel is a cylindrical shell; an upper portion of the exterior of the spline barrel is first external threads for connecting with the sealing end cover, a middle portion thereof is a cylindrical surface of the spline barrel, and a lower portion thereof is second external threads for connecting with the elastic element protection barrel, the outer diameter of the cylindrical surface of the spline barrel is equal to the diameter of the cylindrical surface for fastening of the force transmission shaft; and, an upper portion of the interior of the spline barrel is a centralizing cylinder and a lower portion thereof is an internal spline fitting with the spline, the inner diameter of the centralizing cylinder is greater than the diameter of the first sealing surface of the force transmission shaft, and a spline lubricating liquid chamber is formed by the internal spline and the spline.

A sealing assembly is provided between the sealing end cover and the spline barrel, a first oil injection hole is formed in the middle portion of the spline barrel, and a first oil plug is mounted in the first oil injection hole.

Preferably, the elastic element protection barrel is a cylindrical shell; the outer diameter of the elastic element protection barrel is equal to the diameter of the cylindrical surface for fastening; an upper portion of the interior of the elastic element protection barrel is upper threads for connecting the spline barrel, a middle portion thereof is an elastic element external support surface, and a lower portion thereof is lower threads for connecting the connector, the inner diameter of the elastic element external support surface is 2 to 6 mm greater than the diameter of the elastic element; a second oil injection hole is formed in the middle portion of the elastic element protection barrel; and, a second oil plug is mounted in the second oil injection hole.

The connector is a cylindrical shell; an upper portion of the exterior of connector is elastic element protection barrel connection threads, a middle portion thereof is a connector cylindrical surface, and a lower portion thereof is depressurization barrel connection threads, the diameter of the connector cylindrical surface is equal to the diameter of the cylindrical surface for fastening of the force transmission shaft; the interior of the connector is a connector internal cylindrical surface, the diameter of the connector internal cylindrical surface is greater than the diameter of the elastic element internal support cylindrical surface of the force transmission shaft; and, a seal groove is provided on the connector internal cylindrical surface, and a connector seal is provided in the seal groove.

Preferably, force transmission shaft threads matched with the piston threads are provided inside the liquid separation piston; a mounting surface, a sliding seal surface in sealed connection to a cylinder liner and a second sealing surface in sealed connection to the depressurization barrel are successively provided outside the liquid separation piston; the outer diameter of the sliding seal surface is greater than that of the mounting surface and less than the diameter of the internal surface of the cylinder liner, and the diameter of the external surface of the second sealing surface is less than the outer diameter of the sliding seal surface; a scraper ring is provided between the second sealing surface and the depressurization barrel; and, a liquid separation piston sealing is further provided between the liquid separation piston and the cylinder liner.

Preferably, the exterior of the depressurization barrel is a cylindrical surface with a same diameter; a connector connecting buckle connected to the connector, a depressurization barrel internal surface in sealed connection to the cylinder liner, a cylinder liner pressure-bearing surface, a liquid separation piston lower sliding surface fitted with the bottom end of the second sealing surface of the liquid separation piston, and drill bit connecting threads connected to a drill bit are successively provided inside the depressurization barrel; the cylinder liner pressure-bearing surface is located between the depressurization barrel internal surface and the liquid separation piston lower sliding surface; the second inlet passage and the second drain passage are formed between the cylinder liner pressure-bearing surface and the depressurization barrel external cylindrical surface; the second inlet passage is provided with a second suction valve mounting hole near the depressurization barrel external cylindrical surface for mounting the second suction valve; the second drain passage is provided with a second drain valve mounting hole near the depressurization barrel external cylindrical surface for mounting the second drain valve; and, a cylinder liner sealing is further provided between the cylinder liner pressure-bearing surface and the cylinder liner.

For this purpose, the present application further provides a depressurization method for downhole annulus drilling fluid based on drill string vibration, wherein pressurization is realized by using the depressurization device for downhole annulus drilling fluid described above, during a drilling process, vibrating a drill string downward and pressing down a central shaft, so that an elastic element is compressed under pressure; turning off a second suction valve of a second liquid storage chamber and turning on a second drain valve to drain the liquid in the second liquid storage chamber; generating a negative pressure in a first liquid storage chamber, turning on a first suction valve, and turning off a first drain valve to increase the liquid in the first liquid storage chamber, so that the downhole annulus drilling fluid flows rapidly upward and the pressure of the downhole annulus drilling fluid is reduced; vibrating the drill string downward, lifting the central shaft up, so that the elastic element is expanded and restored; generating a negative pressure in the second liquid storage chamber, turning on the second suction valve, and turning off the second drain valve, the liquid entering the second liquid storage chamber, so that the pressure of the downhole annulus drilling fluid is reduced; turning off the first suction valve of the first liquid storage chamber, turning on the first drain valve, so that the annular drilling fluid is lifted up by fluid; and, repeating the above process to realize the pulse depressurization of the downhole annulus drilling fluid during the upward or downward vibration process of the drill string.

Compared with the prior art, the present application has the following beneficial effects.

(1) In the present application, by using the vibration of the drill string as an energy source, using the internal elastic element as a stroke and restore control component and using the change in flow direction of the liquid in the upper and lower liquid storage chambers, the depressurization of the annular drilling fluid is realized, so that the drilling speed and the rock breaking efficiency can be improved and the downhole cuttings carrying effect can be enhanced.

(2) In the present application, the vibration of the drill string is used as an energy source, and the energy increases with the increase of well depth. During the operation, it is unnecessary to reduce the density of the drilling fluid in the whole well drilling or sacrifice the discharge capacity of the drilling fluid at the drill bit, so that the circulation of the drilling fluid will not be affected. Even if a tool fails, the drilling operation can still be performed continuously, so that the harmful effect of vibration can be reduced and the pressure of the downhole drilling fluid can also be reduced.

(3) The present application is simple in principle and structure and stable in performance, and will not bring any risk in other aspects for the drilling operation when in use, without mounting other tools and affecting the implementation of other drilling procedures.

(4) In the present application, it is unnecessary to change the structure of the drill string, it is independent of the type of the applied drill bit, the range of application is wide, and it is convenient for popularization and application.

(5) In the present invention, the operation and construction during the drilling process are exactly the same as those in the conventional drilling, no special requirements are provided for ground facilities, drilling piping and drill bit type, and it is advantageous for popularization and application.

BRIEF DESCRIPTION OF THE DRAWINGS

FIG. 14 is a structural diagram of a depressurization barrel in one embodiment; in which:

Figure 1:
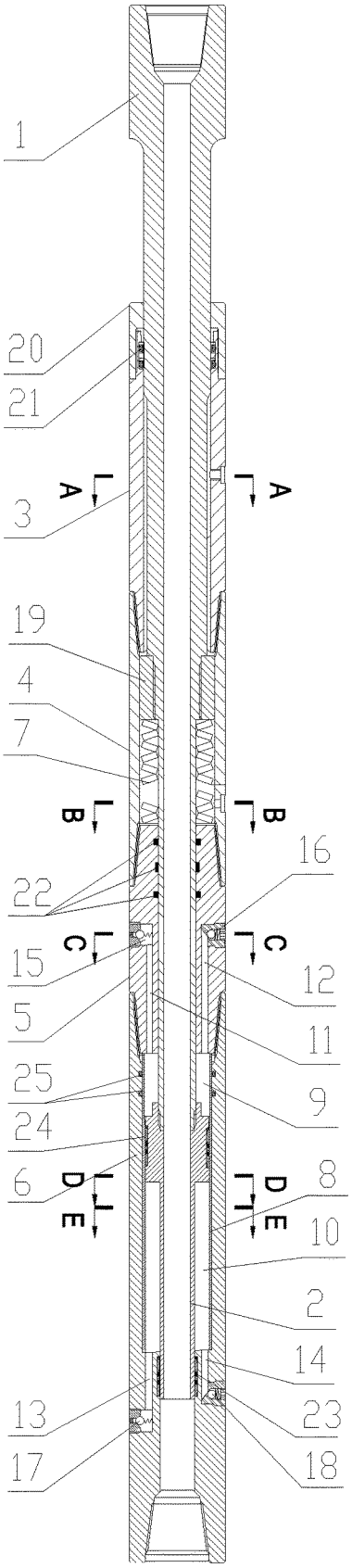
FIG. 1 is a structural diagram of a depressurization device for downhole annulus drilling fluid in one embodiment.

1: force transmission shaft; 101: cylindrical surface for fastening; 102: first sealing surface; 103: internal spline; 104: threads for limit; 105: inner cylindrical surface of the space where the elastic element located; 106: piston threads; 107: circular hole; 108: drill collar threads; 2: liquid separation piston; 201: force transmission shaft threads; 202: sliding seal surface; 203: second sealing surface; 3: spline barrel; 31: first external threads; 32: cylindrical surface of the spline barrel; 33: second external threads; 34: centralizing cylinder; 35: spline lubricating liquid chamber; 301: internal spline; 302: first oil injection hole; 303: first oil plug; 4: elastic element protection barrel; 41: upper threads; 42: elastic element external support surface; 43: lower threads; 401: second oil injection hole; 402: second oil plug; 5: connector; 51: elastic element protection barrel connection threads; 52: connector cylindrical surface; 53: depressurization barrel connection threads; 501: connector internal cylindrical surface; 502: seal groove; 6: depressurization barrel; 601: connector connecting buckle; 602: depressurization barrel internal surface; 603: cylinder liner pressure-bearing surface; 604: liquid separation piston lower sliding surface; 605: drill bit connecting threads; 606: depressurization barrel external cylindrical surface; 607: second suction valve mounting hole; 608: second drain valve mounting hole; 7: elastic element; 8: cylinder liner; 9: first liquid storage chamber; 10: second liquid storage chamber; 11: first inlet passage; 12: first drain passage; 13: second inlet passage; 14: second drain passage; 15: first suction valve; 16: first drain valve; 17: second suction valve; 18: second drain valve; 19: stroke limiter; 20: sealing end cover; 21: sealing assembly; 22: connector seal; 23: scraper ring; 24: liquid separation piston sealing; 25: cylinder liner sealing.

DETAILED DESCRIPTION OF THE PRESENT INVENTION

In the following, the present application will be described in detail through exemplary implementations. However, it should be understood, the elements, structures, and features in one implementation may be beneficially combined in other implementations without further recitation.

In the description of the present application, it is to be noted that the directions or positional relationships indicated by the terms "inside", "outside", "upper", "middle", "lower", and the like are based on the positional relationships shown in the drawings; these terms are merely used to facilitate the description of the present application and simplify the description, and do not indicate or imply that the device or element referred to must have a particular orientation, be constructed and operated in a particular orientation, and therefore should not be interpreted as a limitation on this application. In addition, the terms "first", "second" are used for descriptive purposes and should not be interpreted to indicate or imply the relative importance. The expression "sealed connection" used in the present application means that there is no gap or there is a gap not communicated with the outside after the components are fitted with each other.

Referring to FIGS. 1-8, one of the embodiments of the present application provides a depressurization device for downhole annulus drilling fluid, including a central shaft and a barrel body sheathed outside the central shaft. The central shaft includes a force transmission shaft 1 and a liquid separation piston 2, which are connected successively. The barrel body includes a spline barrel 3, an elastic element protection barrel 4, a connector 5 and a depressurization barrel 6, which are all connected successively. The spline barrel 3, the elastic element protection barrel 4 and the connector 5 are sheathed outside the force transmission shaft 1. An elastic element 7 is provided between the elastic element protection barrel 4 and the force transmission shaft 1. The elastic element 7 can be compressed or restored along with the downward or upward movement of the force transmission shaft 1. A cylinder liner 8 is sheathed inside the depressurization barrel 6, and the cylinder liner 8 is sheathed outside the liquid separation piston 2. A first liquid storage chamber 9 is formed among the depressurization barrel 6, the connector 5 and the liquid separation piston 2, and a second liquid storage chamber 10 is formed between the depressurization barrel 6 and the liquid separation piston 2. The connector 5 is provided with a downward first inlet passage 11 and an upward first drain passage 12 which both communicate the outside with the first liquid storage chamber 9 respectively. The depressurization barrel 6 is provided with an upward second inlet passage 13 and a downward second drain passage 14 which both communicate the outside with the second liquid storage chamber 10 respectively. At an end of the first inlet passage 11 which communicated with the outside, a first suction valve 15 is provided, and at an end of the first drain passage 12 which communicated with the outside, a first drain valve 16 is provided. At an end of the second inlet passage 13 which communicated with the outside, a second suction valve 17 is provided, and at an end of the second drain passage 14 which communicated with the outside, a second drain valve 18 is provided.

In this embodiment, it is to be noted that, to prevent the direct friction between the liquid separation piston 2 and the depressurization barrel 6 from resulting in device abrasion and scrapping, preferably, a cylinder liner 8 is provided on the internal surface of the depressurization barrel 6. The cylinder liner 8 may be made of a wear-resistant material and may be replaced periodically according to wear state. However, it should be understood that the present invention can also be implemented without any cylinder liner 8. When a cylinder liner 8 is provided inside the depressurization barrel 6, the first liquid storage chamber 9 is actually formed by the cylinder liner 8, the connector 5 and the liquid separation piston 2; the second liquid storage chamber 10 is actually formed by the depressurization barrel 6 and the liquid separation piston 2. In addition, the terms "upward" and "downward" used for describing the inlet passages 11, 13 and the drain passages 12, 14 are indicated by the flow-in and flow-out directions of the liquid.

When in use, the depressurization device for downhole annulus drilling fluid provided in this embodiment is mounted below a drill string, and realizes the depressurization of the annular drilling fluid by using the vibration of the drill string as an energy source, using the elastic element 7 as a compression stroke and reset control component, and using the change in flow direction of the drilling fluid in the first liquid storage chamber 9 and the second liquid storage chamber 10, so as to achieve the purpose of improving the well drilling speed.

Figure 2:
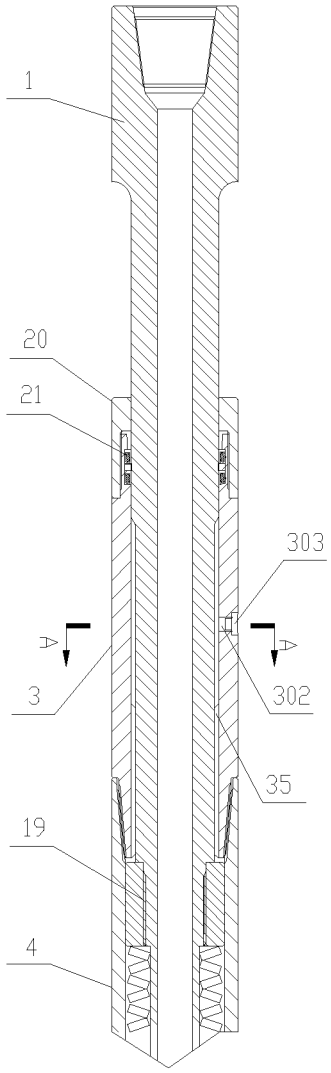
FIG. 2 is a structural diagram of the upper half of a depressurization device for downhole annulus drilling fluid in one embodiment.

Still referring to FIGS. 1 and 2, as a preferred implementation of the depressurization device, a stroke limiter 19 is provided between the force transmission shaft 1 and the elastic element protection barrel 4; the stroke limiter 19 can synchronously move with the force transmission shaft 1, and is in sliding fit with the elastic element protection barrel 4; and, an upper end of the elastic element 7 is in contact-type connection to the stroke limiter 9, while a lower end of the elastic element 7 is in contact-type connection to the connector 5. The stroke limiter 19 is provided to adjust the stroke distance of the force transmission shaft 1.

Still referring to FIGS. 1 and 2, as a preferred solution of the depressurization device, the barrel body further includes a sealing end cover 20 provided at an upper end of the spline barrel 3, and the sealing end cover 20 is sheathed outside the force transmission shaft 1. By sealing the force transmission shaft 1 using the sealing end cover 20, the outflow of the drilling fluid is prevented.

Figure 3:
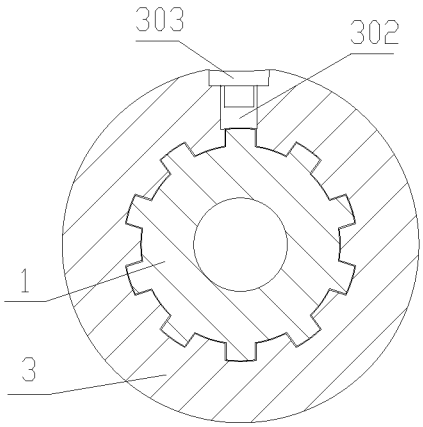
FIG. 3 is a cross-sectional view of FIG. 2 taken along line A-A.
Figure 9:
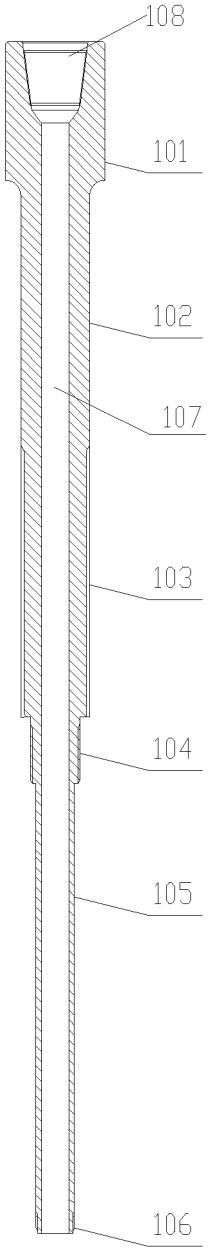
FIG. 9 is a structural diagram of a force transmission shaft in one embodiment.

Referring to FIG. 9, as a preferred implementation of the depressurization device, the force transmission shaft 1 is provided with a circular hole 107 along its axis for the drilling fluid flowing, and drill collar threads 108 for connecting a drill tool assembly is provided at a top end of the force transmission shaft 1. A cylindrical surface for fastening 101, a first sealing surface 102 in sealed connection to the sealing end cover 20, a spline 103 in sealed connection to the spline barrel 3, threads for limit 104 for connecting with the stroke limiter 19, an inner surface of the space where the elastic element is located 105 and piston threads 106 for connecting with the liquid separation piston 2 are provided outside the force transmission shaft 1 successively from the top down, wherein, the cylindrical surface for fastening 101 is fastened tightly to a drill string provided in the upper portion to achieve sealing fit, the diameter of the first sealing surface 102 is less than that of the cylindrical surface for fastening 101. As shown in FIG. 3, the spline 103 and the spline barrel 3 are fitted with each other by a spline to transfer torque. The addendum circle diameter of the spline 103 is equal to the diameter of the first sealing surface 102, the root circle diameter of the spline 103 is greater than the major diameter of the threads for limit 104, the minor diameter of the threads for limit 104 is greater than the diameter of the elastic element internal support cylindrical surface 105, and the diameter of the elastic element internal support cylindrical surface 105 is greater than the major diameter of the piston threads 106.

Figure 10:
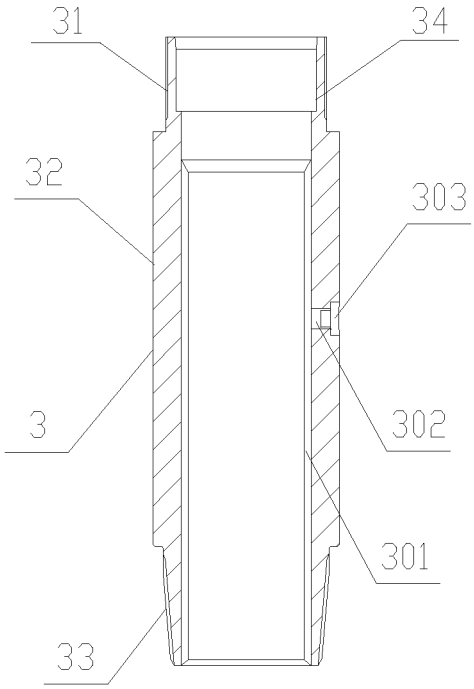
FIG. 10 is a structural diagram of a spline barrel in one embodiment.

Still referring to FIG. 2 and also referring to FIGS. 3 and 10, as a preferred implementation of the pressurization device, the spline barrel 3 is a cylindrical shell; an upper portion of the exterior of the spline barrel 3 is first external threads 31 for connecting with the sealing end cover 20, a middle portion thereof is a cylindrical surface of the spline barrel 32, and a lower portion thereof is second external threads 33 for connecting with the elastic element protection barrel 4, the outer diameter of the cylindrical surface of the spline barrel 32 is equal to the diameter of the cylindrical surface for fastening 101 of the force transmission shaft 1. An upper portion of interior of the spline barrel 3 is a centralizing cylinder 34 and a lower portion thereof is an internal spline 301 fitting with the spline 103, the inner diameter of the centralizing cylinder is greater than the diameter of the first sealing surface 102 of the force transmission shaft 1, and the internal spline 301 and the spline 103 form a spline lubricating liquid chamber 35; and, the spline barrel 3 can slide up and down relative to the force transmission shaft 1.

In above implementation, the spline lubricating liquid chamber 35 is a tooth clearance formed after the internal spline 301 is fitted with the spline 103. By filling the lubricating liquid in the tooth clearance, it is advantageous for the upward or downward movement of the force transmission shaft 1.

Figure 4:
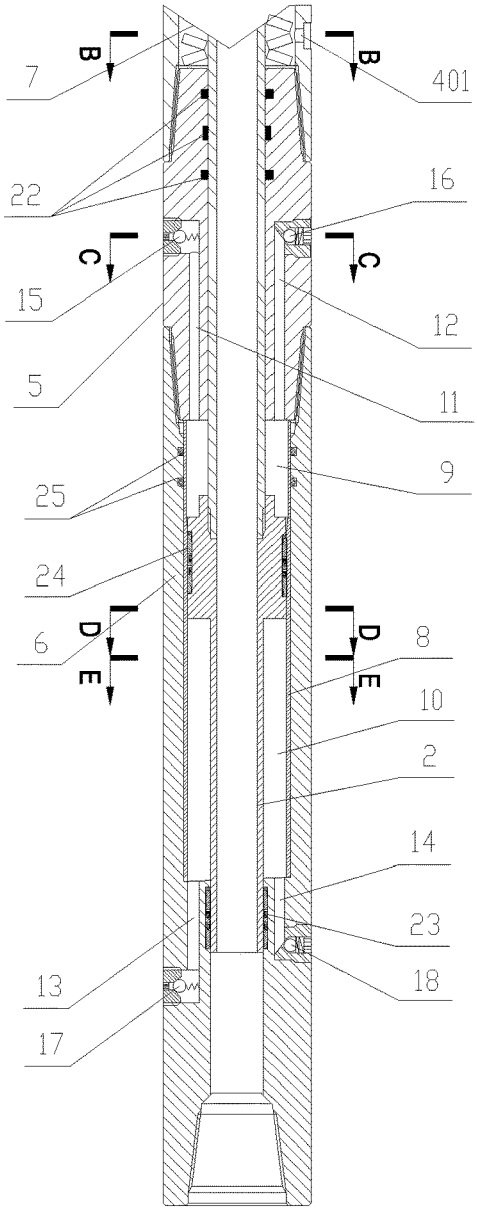
FIG. 4 is a structural diagram of the lower half of a depressurization device for downhole annulus drilling fluid in one embodiment.
Figure 5:
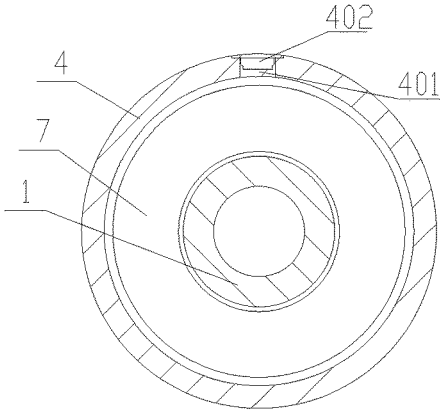
FIG. 5 is a cross-sectional view of FIG. 4 taken along line B-B.
Figure 11:
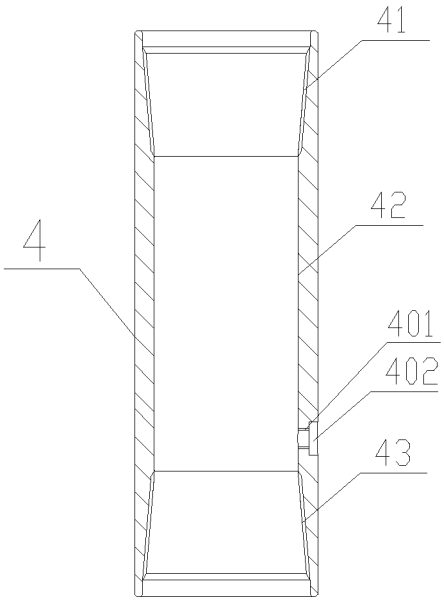
FIG. 11 is a structural diagram of an elastic element protection barrel in one embodiment.

Further referring to FIG. 2, a sealing assembly 21 is provided between the sealing end cover 20 and the spline barrel 3, a first oil injection hole 302 is formed in the middle portion of the spline barrel 3, and a first oil plug 303 is mounted in the first oil injection hole 302, wherein, the sealing assembly 21 is used for preventing the lubricating liquid in the spline lubricating liquid chamber 35 from flowing into the annulus. The first oil injection hole 302 is used for injecting the lubricating liquid into the spline lubricating liquid chamber, and the first oil plug 303 is used for preventing the outflow of the lubricating liquid. Specifically, the sealing assembly 21 is arranged in a space formed by the sealing end cover 20, the spline barrel 3 and the force transmission shaft 1 for purpose of sealing. Referring to FIGS. 4, 5 and 11, as a preferred implementation of the depressurization device, the elastic element protection barrel 4 is a cylindrical shell; the outer diameter of the elastic element protection barrel 4 is equal to the diameter of the cylindrical surface for fastening 101; an upper portion of the interior of the elastic element protection barrel 4 is upper threads 41 for connecting with the spline barrel 3, a middle portion thereof is an elastic element external support surface 42, and a lower portion thereof is lower threads 43 for connecting with the connector 5; the inner diameter of the elastic element external support surface 42 is 2 to 6 mm greater than the diameter of the elastic element; a second oil injection hole 401 is formed in the middle portion of the elastic element protection barrel 4; and, a second oil plug 402 is mounted in the second oil injection hole 401. The second oil injection hole 401 is used for injecting the lubricating liquid into an elastic element accommodating chamber (which is formed by the elastic element protection barrel 4 and the force transmission shaft 1) used for accommodating the elastic element 7, and the second oil plug 402 is used for preventing the outflow of the lubricating liquid.

Figure 6:
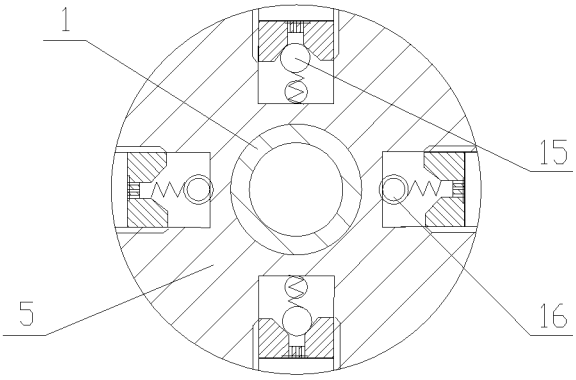
FIG. 6 is a cross-sectional view of FIG. 4 taken along line C-C.
Figure 12:
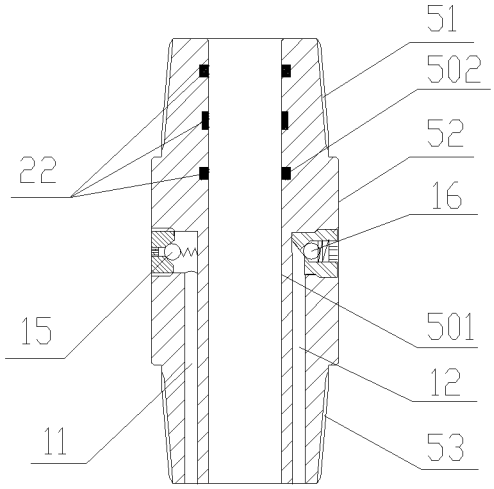
FIG. 12 is a structural diagram of a connector in one embodiment.

Referring to FIGS. 4, 6 and 12, as a preferred implementation of the depressurization device, the connector 5 is a cylindrical shell; an upper portion of the exterior of the connector 5 is elastic element protection barrel connection threads 51, a middle portion thereof is a connector cylindrical surface 52, and a lower portion thereof is depressurization barrel connection threads 53, the diameter of the connector cylindrical surface 52 is equal to the diameter of the cylindrical surface for fastening 101 of the force transmission shaft 1; the interior of the connector 5 is a connector internal cylindrical surface 501, the diameter of the connector internal cylindrical surface 501 is greater than the diameter of the elastic element internal support cylindrical surface 105 of the force transmission shaft 1; and, a seal groove 502 is provided on the connector internal cylindrical surface 501, and a connector seal 22 is provided in the seal groove 502. By sealing the force transmission shaft 1 and the connector 5 using the connector seal 22, the drilling fluid is prevented from flowing into the annulus.

Figure 7:
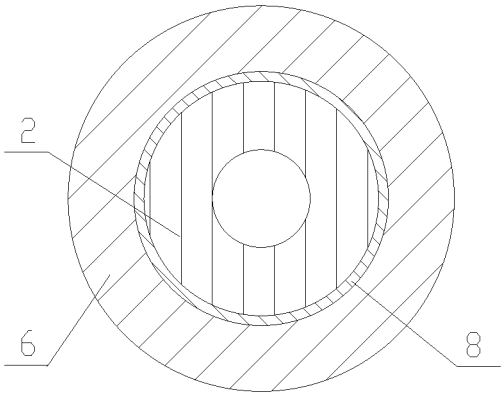
FIG. 7 is a cross-sectional view of FIG. 4 taken along line D-D.
Figure 8:
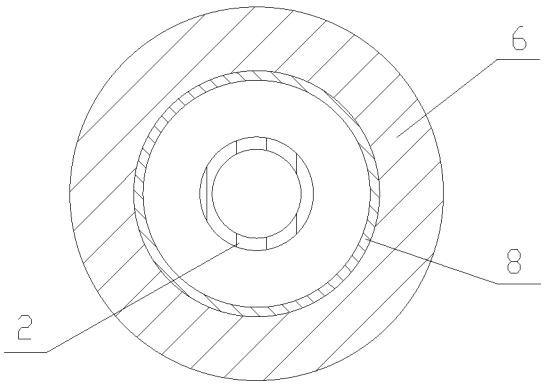
FIG. 8 is a cross-sectional view of FIG. 4 taken along line E-E.
Figure 13:
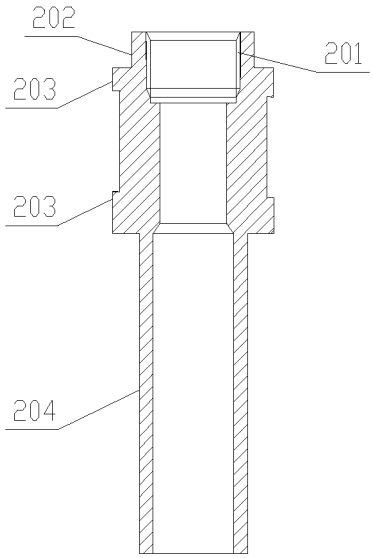
FIG. 13 is a structural diagram of a liquid separation piston in one embodiment.

Referring to FIGS. 13, 7 and 8, as a preferred implementation of the depressurization device, force transmission shaft threads 201 matched with the piston threads 106 are provided at an upper side of the interior of the liquid separation piston 2; a mounting surface 202, a sliding seal surface 203 in sealed connection to the cylinder liner 8 and a second sealing surface 204 in sealed connection to the depressurization barrel 6 are successively provided outside the liquid separation piston 2, wherein the mounting surface 202 is used only in the process of mounting and disassembling the liquid separation piston 2; the outer diameter of the sliding seal surface 203 is greater than that of the mounting surface 202 and less than the diameter of the internal surface of the cylinder liner 8, and the diameter of the external surface of the second sealing surface 204 is less than the outer diameter of the sliding seal surface 203; and, the bottom end of the second sealing surface 204 is in sliding and seal fit with a liquid separation piston lower sliding surface 604, so that the second liquid storage chamber 10 is not communicated with the circular hole 107. Further referring to FIG. 4, a scraper ring 23 is provided between the second sealing surface 204 and the depressurization barrel 6, and a liquid separation piston sealing 24 is provided between the liquid separation piston 2 and the cylinder liner 8. As shown in FIG. 13, a recess is formed between the sliding seal surface 203 of the liquid separation piston 2, and a liquid separation piston sealing 24 is provided between the recess and the cylinder liner 8.

Figure 14:
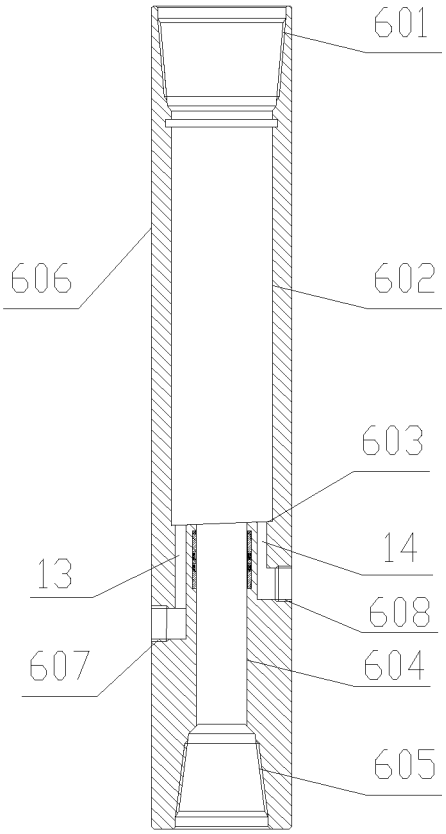

Referring to FIG. 14, as a preferred implementation of the depressurization device, the exterior of the depressurization barrel 6 is a cylindrical surface with a same diameter; a connector connecting buckle 601 connected to the connector 5, a depressurization barrel internal surface 602 in sealed connection to the cylinder liner 8, a cylinder liner pressure-bearing surface 603, the liquid separation piston lower sliding surface 604 fitted with the bottom end of the second sealing surface 204 of the liquid separation piston 2, and drill bit connecting threads 605 connected to a drill bit are successively provided inside the depressurization barrel 6; the cylinder liner pressure-bearing surface 603 is located between the depressurization barrel internal surface 602 and the liquid separation piston lower sliding surface 604, and the cylinder liner pressure-bearing surface 603 is formed as a step surface to provide axial support for the cylinder liner 8; the second inlet passage 13 and the second drain passage 14 are formed between the cylinder liner pressure-bearing surface 603 and the depressurization barrel external cylindrical surface 606; a second suction valve mounting hole 607 for mounting the second suction valve 17 is provided on the second inlet passage 13 close to the depressurization barrel external cylindrical surface 606; and, a second drain valve mounting hole 608 for mounting the second drain valve 18 is provided on the second drain passage 14 close to the depressurization barrel external cylindrical surface 606. Further referring to FIG. 4, a cylinder liner sealing 25 is further provided between the depressurization barrel internal surface 602 and the cylinder liner 8.

During the drilling process, the downhole annulus drilling fluid is depressurized by the depressurization device for downhole annulus drilling fluid described in the above implementations. The depressurization process will be described below.

The drill string pressure is increased, the central shaft is pressed down, and the force transmission shaft 1 drives the liquid separation piston 2 to move down, so that the elastic element 7 is compressed under pressure, the volume of the second liquid storage chamber 10 is decreased, and the pressure in the second liquid storage chamber 10 is increased. The second suction valve 17 is turned off, and the second drain valve 18 is turned on, so that the drilling fluid in the second liquid storage chamber 10 is drained. Since the liquid separation piston 2 is moved down, the volume of the first liquid storage chamber 9 is increased, so that a negative pressure is generated in the first liquid storage chamber 9. The first suction valve 15 is turned on, and the first drain valve 16 is turned off, so that the annular drilling fluid flows into the first liquid storage chamber 9 located at upper, and the amount of the drilling fluid in the first liquid storage chamber 9 is increased. At this time, the annular drilling fluid flows rapidly upward, and the pressure of the downhole drilling fluid is reduced.

The drill string pressure is decreased, the central shaft is lifted up, and the force transmission shaft 1 drives the liquid separation piston 2 to move up, so that the elastic element 7 is expanded and restored, the volume of the second liquid storage chamber 10 is increased, and a negative pressure is generated in the second liquid storage chamber 10. The second suction valve 17 is turned on, and the second drain valve 18 is turned off, so that the drilling fluid flows into the second liquid storage chamber 10 from the second suction valve 17, and the pressure of the downhole annulus drilling fluid is reduced. Since the liquid separation piston 2 is moved up, the volume of the first liquid storage chamber 9 is decreased. The first suction valve 15 is turned off, and the first drain valve 16 is turned on, so that drilling fluid in the first liquid storage chamber 9 flows out and the annular drilling fluid is lifted up.

Another embodiment of the present application provides a depressurization method for downhole annulus drilling fluid based on the vibration of a drill string, the depressurization device for downhole annulus drilling fluid described above is used to achieve depressurization, during a drilling process, vibrating a drill string downward and pressing down a central shaft, so that an elastic element 7 is compressed under pressure, turning off a second suction valve 17 of a second liquid storage chamber 10 and turning on a second drain valve 18 to drain the liquid in the second liquid storage chamber 10; generating a negative pressure in a first liquid storage chamber 9, turning on a first suction valve 15, and turning off a first drain valve 16 to increase the liquid in the first liquid storage chamber 9, so that the downhole annulus drilling fluid flows rapidly upward and the pressure of the downhole annulus drilling fluid is reduced; vibrating the drill string downward, lifting the central shaft up, so that the elastic element 7 is expanded and restored; generating a negative pressure in the second liquid storage chamber 10, turning on the second suction valve 17, and turning off the second drain valve 18, the liquid entering the second liquid storage chamber 10, so that the pressure of the downhole annulus drilling fluid is reduced; turning off the first suction valve 15 of the first liquid storage chamber 9, turning on the first drain valve 16, so that the annular drilling fluid is lifted up by fluid; and, repeating the above process to realize the pulse depressurization of the downhole annulus drilling fluid during the upward or downward vibration process of the drill string.

In the method provided by the present application, by using the vibration of the drill string as an energy source, using the elastic element as a compression stroke and restore control component and using the change in flow direction of the liquid in the upper and lower liquid storage chambers, the depressurization of the annular drilling fluid is realized, so that the drilling speed and the rock breaking efficiency can be improved and the downhole cuttings carrying effect can be enhanced.

In addition, in the device and method provided by the present application, the elastic element is preferably a spring.

The above implementations are used to explain the present application, rather than limiting the present application. Any modification and change made to the present application within the spirit of the present application and the protection scope of the claims fall into the protection scope of the present application.

The invention claimed is:

1. A depressurization device for downhole annulus drilling fluid, comprising a central shaft and a barrel body sheathed outside the central shaft, wherein the central shaft comprises a force transmission shaft and a liquid separation piston, which are connected successively; the barrel body comprises a spline barrel, an elastic element protection barrel, a connector and a depressurization barrel, which are all connected successively; the elastic element protection barrel and the connector are sheathed outside the force transmission shaft; an elastic element is provided between the elastic element protection barrel and the force transmission shaft; a cylinder liner is sheathed inside the depressurization barrel, and the cylinder liner is sheathed outside the liquid separation piston, a first liquid storage chamber is formed among the depressurization barrel, the connector and the liquid separation piston, and a second liquid storage chamber is formed between the depressurization barrel and the liquid separation piston; a downward first inlet passage and an upward first drain passage which both communicate outside with the first liquid storage chamber are provided on the connector; an upward second inlet passage and a downward second drain passage which both communicate the outside with the second liquid storage chamber are provided on the depressurization barrel; at an end of the first inlet passage which communicated with the outside, a first suction valve is provided; at an end of the first drain passage which communicated with the outside, a first drain valve is provided; at an end of the second inlet passage which communicated with the outside, a second suction valve is provided; and, at an end of the second drain passage which communicated with the outside, a second drain valve is provided.

2. The depressurization device for downhole annulus drilling fluid according to claim 1, wherein a stroke limiter is provided between the force transmission shaft and the elastic element protection barrel; and, an end of the elastic element is in contact-type connection to the stroke limiter, while the other end thereof is in contact-type connection to the connector.

3. The depressurization device for downhole annulus drilling fluid according to claim 2, wherein the barrel body further comprises a sealing end cover, the sealing end cover is sheathed outside the force transmission shaft.

4. The depressurization device for downhole annulus drilling fluid according to claim 3, wherein the force transmission shaft is provided with a circular hole along an axis of the force transmission shaft for the drilling fluid flowing, and a drill collar threads for connecting a drill tool assembly is provided at a top end of the force transmission shaft; and, a cylindrical surface for fastening, a first sealing surface in sealed connection to the sealing end cover, a spline in sealed connection to the spline barrel, threads for limit for connecting with the stroke limiter, an inner cylindrical surface of the space where the elastic element is located and piston threads for connecting with the liquid separation piston are successively provided outside the force transmission shaft, a diameter of the first sealing surface is less than that of the cylindrical surface for fastening, an addendum circle diameter of the spline is equal to the diameter of the first sealing surface, a root circle diameter of the spline is greater than a major diameter of the threads for limit, a minor diameter of the threads for limit is greater than a diameter of the elastic element internal support cylindrical surface, and the diameter of the elastic element internal support cylindrical surface is greater than a major diameter of the piston threads.

5. The depressurization device for downhole annulus drilling fluid according to claim 4, wherein the spline barrel is a cylindrical shell; an upper portion of the exterior of the spline barrel is first external threads for connecting with the sealing end cover, a middle portion thereof is a cylindrical surface of the spline barrel, and a lower portion thereof is second external threads for connecting with the elastic element protection barrel, an outer diameter of the cylindrical surface of the spline barrel is equal to the diameter of the cylindrical surface for fastening of the force transmission shaft; and, an upper portion of the interior of the spline barrel is a centralizing cylinder and a lower portion thereof is an internal spline fitting with the spline, an inner diameter of the centralizing cylinder is greater than the diameter of the first sealing surface of the force transmission shaft, and a spline lubricating liquid chamber is formed by the internal spline and the spline.

6. The depressurization device for downhole annulus drilling fluid according to claim 5, wherein a sealing assembly is provided between the sealing end cover and the spline barrel, a first oil injection hole is formed in the middle portion of the spline barrel, and a first oil plug is mounted in the first oil injection hole.

7. The depressurization device for downhole annulus drilling fluid according to claim 3, wherein the elastic element protection barrel is a cylindrical shell; an outer diameter of the elastic element protection barrel is equal to the diameter of the cylindrical surface for fastening; an upper portion of the interior of the elastic element protection barrel is upper threads for connecting the spline barrel, a middle portion thereof is an elastic element external support surface, and a lower portion thereof is lower threads for connecting the connector, an inner diameter of the elastic element external support surface is 2 to 6 mm greater than a diameter of the elastic element; a second oil injection hole is formed in the middle portion of the elastic element protection barrel; and, a second oil plug is mounted in the second oil injection hole.

8. The depressurization device for downhole annulus drilling fluid according to claim 3, wherein the connector is a cylindrical shell; an upper portion of the exterior of connector is elastic element protection barrel connection threads, a middle portion thereof is a connector cylindrical surface, and a lower portion thereof is depressurization barrel connection threads, a diameter of the connector cylindrical surface is equal to the diameter of the cylindrical surface for fastening of the force transmission shaft; the interior of the connector is a connector internal cylindrical surface, a diameter of the connector internal cylindrical surface is greater than the diameter of the elastic element internal support cylindrical surface of the force transmission shaft; and, a seal groove is provided on the connector internal cylindrical surface, and a connector seal is provided in the seal groove.

9. The depressurization device for downhole annulus drilling fluid according to claim 8, wherein the exterior of the depressurization barrel is a cylindrical surface with a same diameter; a connector connecting buckle connected to the connector, a depressurization barrel internal surface in sealed connection to the cylinder liner, a cylinder liner pressure-bearing surface, a liquid separation piston lower sliding surface fitted with the bottom end of the second sealing surface of the liquid separation piston, and drill bit connecting threads connected to a drill bit are successively provided inside the depressurization barrel; the cylinder liner pressure-bearing surface is located between the depressurization barrel internal surface and the liquid separation piston lower sliding surface; the second inlet passage and the second drain passage are formed between the cylinder liner pressure-bearing surface and the depressurization barrel external cylindrical surface; the second inlet passage is provided with a second suction valve mounting hole near the depressurization barrel external cylindrical surface for mounting the second suction valve; the second drain passage is provided with a second drain valve mounting hole near the depressurization barrel external cylindrical surface for mounting the second drain valve; and, a cylinder liner sealing is further provided between the cylinder liner pressure-bearing surface and the cylinder liner.

10. The depressurization device for downhole annulus drilling fluid according to claim 3, wherein force transmission shaft threads matched with the piston threads are provided inside the liquid separation piston; a mounting surface, a sliding seal surface in sealed connection to a cylinder liner and a second sealing surface in sealed connection to the depressurization barrel are successively provided outside the liquid separation piston; an outer diameter of the sliding seal surface is greater than that of the mounting surface and less than a diameter of the internal surface of the cylinder liner, and a diameter of the external surface of the second sealing surface is less than the outer diameter of the sliding seal surface; a scraper ring is provided between the second sealing surface and the depressurization barrel; and, a liquid separation piston sealing is further provided between the liquid separation piston and the cylinder liner.

11. A depressurization method for downhole annulus drilling fluid based on drill string vibration, wherein pressurization is realized by using the depressurization device for downhole annulus drilling fluid according to claim 1, during a drilling process, vibrating a drill string downward and pressing down a central shaft, so that an elastic element is compressed under pressure; turning off a second suction valve of a second liquid storage chamber and turning on a second drain valve to drain the liquid in the second liquid storage chamber; generating a negative pressure in a first liquid storage chamber, turning on a first suction valve, and turning off a first drain valve to increase the liquid in the first liquid storage chamber, so that the downhole annulus drilling fluid flows rapidly upward and the pressure of the downhole annulus drilling fluid is reduced; vibrating the drill string downward, lifting the central shaft up, so that the elastic element is expanded and restored; generating a negative pressure in the second liquid storage chamber, turning on the second suction valve, and turning off the second drain valve, the liquid entering the second liquid storage chamber, so that the pressure of the downhole annulus drilling fluid is reduced; turning off the first suction valve of the first liquid storage chamber, turning on the first drain valve, so that the annular drilling fluid is lifted up by fluid; and, repeating the above process to realize the pulse depressurization of the downhole annulus drilling fluid during the upward or downward vibration process of the drill string.

12. A depressurization method for downhole annulus drilling fluid based on drill string vibration, wherein pressurization is realized by using the depressurization device for downhole annulus drilling fluid according to claim 2, during a drilling process, vibrating a drill string downward and pressing down a central shaft, so that an elastic element is compressed under pressure; turning off a second suction valve of a second liquid storage chamber and turning on a second drain valve to drain the liquid in the second liquid storage chamber; generating a negative pressure in a first liquid storage chamber, turning on a first suction valve, and turning off a first drain valve to increase the liquid in the first liquid storage chamber, so that the downhole annulus drilling fluid flows rapidly upward and the pressure of the downhole annulus drilling fluid is reduced; vibrating the drill string downward, lifting the central shaft up, so that the elastic element is expanded and restored; generating a negative pressure in the second liquid storage chamber, turning on the second suction valve, and turning off the second drain valve, the liquid entering the second liquid storage chamber, so that the pressure of the downhole annulus drilling fluid is reduced; turning off the first suction valve of the first liquid storage chamber, turning on the first drain valve, so that the annular drilling fluid is lifted up by fluid; and, repeating the above process to realize the pulse depressurization of the downhole annulus drilling fluid during the upward or downward vibration process of the drill string.

13. A depressurization method for downhole annulus drilling fluid based on drill string vibration, wherein pressurization is realized by using the depressurization device for downhole annulus drilling fluid according to claim 3, during a drilling process, vibrating a drill string downward and pressing down a central shaft, so that an elastic element is compressed under pressure; turning off a second suction valve of a second liquid storage chamber and turning on a second drain valve to drain the liquid in the second liquid storage chamber; generating a negative pressure in a first liquid storage chamber, turning on a first suction valve, and turning off a first drain valve to increase the liquid in the first liquid storage chamber, so that the downhole annulus drilling fluid flows rapidly upward and the pressure of the downhole annulus drilling fluid is reduced; vibrating the drill string downward, lifting the central shaft up, so that the elastic element is expanded and restored; generating a negative pressure in the second liquid storage chamber, turning on the second suction valve, and turning off the second drain valve, the liquid entering the second liquid storage chamber, so that the pressure of the downhole annulus drilling fluid is reduced; turning off the first suction valve of the first liquid storage chamber, turning on the first drain valve, so that the annular drilling fluid is lifted up by fluid; and, repeating the above process to realize the pulse depressurization of the downhole annulus drilling fluid during the upward or downward vibration process of the drill string.

14. A depressurization method for downhole annulus drilling fluid based on drill string vibration, wherein pressurization is realized by using the depressurization device for downhole annulus drilling fluid according to claim 4, during a drilling process, vibrating a drill string downward and pressing down a central shaft, so that an elastic element is compressed under pressure; turning off a second suction valve of a second liquid storage chamber and turning on a second drain valve to drain the liquid in the second liquid storage chamber; generating a negative pressure in a first liquid storage chamber, turning on a first suction valve, and turning off a first drain valve to increase the liquid in the first liquid storage chamber, so that the downhole annulus drilling fluid flows rapidly upward and the pressure of the downhole annulus drilling fluid is reduced; vibrating the drill string downward, lifting the central shaft up, so that the elastic element is expanded and restored; generating a negative pressure in the second liquid storage chamber, turning on the second suction valve, and turning off the second drain valve, the liquid entering the second liquid storage chamber, so that the pressure of the downhole annulus drilling fluid is reduced; turning off the first suction valve of the first liquid storage chamber, turning on the first drain valve, so that the annular drilling fluid is lifted up by fluid; and, repeating the above process to realize the pulse depressurization of the downhole annulus drilling fluid during the upward or downward vibration process of the drill string.

15. A depressurization method for downhole annulus drilling fluid based on drill string vibration, wherein pressurization is realized by using the depressurization device for downhole annulus drilling fluid according to claim 5, during a drilling process, vibrating a drill string downward and pressing down a central shaft, so that an elastic element is compressed under pressure; turning off a second suction valve of a second liquid storage chamber and turning on a second drain valve to drain the liquid in the second liquid storage chamber; generating a negative pressure in a first liquid storage chamber, turning on a first suction valve, and turning off a first drain valve to increase the liquid in the first liquid storage chamber, so that the downhole annulus drilling fluid flows rapidly upward and the pressure of the downhole annulus drilling fluid is reduced; vibrating the drill string downward, lifting the central shaft up, so that the elastic element is expanded and restored; generating a negative pressure in the second liquid storage chamber, turning on the second suction valve, and turning off the second drain valve, the liquid entering the second liquid storage chamber, so that the pressure of the downhole annulus drilling fluid is reduced; turning off the first suction valve of the first liquid storage chamber, turning on the first drain valve, so that the annular drilling fluid is lifted up by fluid; and, repeating the above process to realize the pulse depressurization of the downhole annulus drilling fluid during the upward or downward vibration process of the drill string.

* * * * *